US009777942B2

(12) United States Patent
Hill

(10) Patent No.: US 9,777,942 B2
(45) Date of Patent: Oct. 3, 2017

(54) METHODS AND APPARATUS FOR PROVIDING AN IMPROVED DAMPER, BOOT AND DAMPER COMBINATION, AND AN IMPROVED HVAC DUCT SYSTEM

(71) Applicant: Lee M. Hill, Raleigh, NC (US)

(72) Inventor: Lee M. Hill, Raleigh, NC (US)

(73) Assignee: H & H INNOVATIONS, LLC, Raleigh, NC (US)

( * ) Notice: Subject to any disclaimer, the term of this patent is extended or adjusted under 35 U.S.C. 154(b) by 268 days.

(21) Appl. No.: 14/638,847

(22) Filed: Mar. 4, 2015

(65) Prior Publication Data

US 2015/0330661 A1 Nov. 19, 2015

Related U.S. Application Data

(60) Provisional application No. 61/993,096, filed on May 14, 2014.

(51) Int. Cl.
*F24F 7/00* (2006.01)
*F24F 13/10* (2006.01)
*F24F 13/14* (2006.01)

(52) U.S. Cl.
CPC ..... *F24F 13/1486* (2013.01); *F24F 13/10* (2013.01); *F24F 13/14* (2013.01)

(58) Field of Classification Search
CPC .... F24F 13/1426; F24F 13/1486; F24F 13/10; F24F 13/14
See application file for complete search history.

(56) References Cited

U.S. PATENT DOCUMENTS 405,620 A * 6/1889 Tallmage ..... F24F 13/06 454/290
833,554 A * 10/1906 Schwoll ..... F24F 13/1426 126/295
2,633,071 A * 3/1953 Erickson ..... F24F 11/0001 110/162
2,835,467 A * 5/1958 Guildford ..... F16K 1/22 251/308
3,541,944 A * 11/1970 Kristiansen ..... F24F 11/04 251/212
3,605,797 A * 9/1971 Dieckmann et al. . F16L 59/153 137/375
RE28,492 E * 7/1975 Hedrick ..... F16K 1/223 137/316
4,203,332 A * 5/1980 Corsetti ..... F24F 13/10 294/209

(Continued)

OTHER PUBLICATIONS

"Edco Products Inc.: Balancing Damper", theNEWS, Feb. 25, 2008, http://www.achrnews.com/articles/106068-edco-products-inc-balancing-damper.

*Primary Examiner* — Steven B McAllister
*Assistant Examiner* — Jonathan Cotov
(74) *Attorney, Agent, or Firm* — Hultquist, PLLC; Peter H. Priest

(57) ABSTRACT

A damper arrangement is described which moves dampers from a location closer to an air source to a boot located adjacent to a ceiling register, grill, or the like, thereby allowing technicians or owners to more readily make adjustments. A substantially flush boot collar mounting preserves leak free flow, and keeps insulation installation simple. An internal adjustment mechanism, such as a loop, avoids the need to pull the ceiling grill from the ceiling. Both insulation and subsequent adjustment are simplified.

7 Claims, 17 Drawing Sheets

(56) References Cited

U.S. PATENT DOCUMENTS

| | | | | | |
|---|---|---|---|---|---|
| 4,628,954 | A * | 12/1986 | Dayus | F16K 15/036 | 137/375 |
| 4,949,625 | A * | 8/1990 | Miklos | F24F 13/1426 | 251/115 |
| 5,207,615 | A * | 5/1993 | Edmisten | F24F 13/0236 | 251/297 |
| 5,921,277 | A * | 7/1999 | Bernal | F16K 27/0218 | 137/315.24 |
| 5,980,381 | A * | 11/1999 | McCormick | F24F 13/06 | 454/259 |
| 6,418,964 | B1 * | 7/2002 | Kearney | F16C 11/02 | 137/601.09 |
| 6,464,579 | B1 * | 10/2002 | Salazar | F24F 13/065 | 454/202 |
| 7,393,021 | B1 | 7/2008 | Lukjan | | |
| 7,410,416 | B2 * | 8/2008 | Fettkether | F24F 13/0218 | 454/265 |
| 8,951,103 | B2 * | 2/2015 | Votaw | F24F 13/1413 | 454/239 |
| 2005/0017507 | A1 * | 1/2005 | Jensen | F16L 25/14 | 285/197 |
| 2008/0014859 | A1 * | 1/2008 | Edmisten | F24F 13/084 | 454/290 |
| 2010/0197217 | A1 * | 8/2010 | Yoskowitz | F24F 13/1486 | 454/317 |
| 2011/0100050 | A1 * | 5/2011 | Mediato Martinez | F24F 13/1426 | 62/408 |

* cited by examiner

FIG. 4E
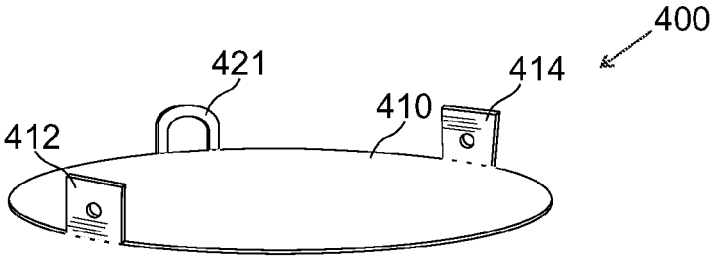
FIG. 4F
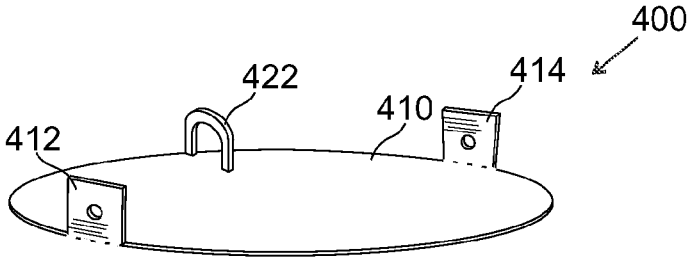
FIG. 4G
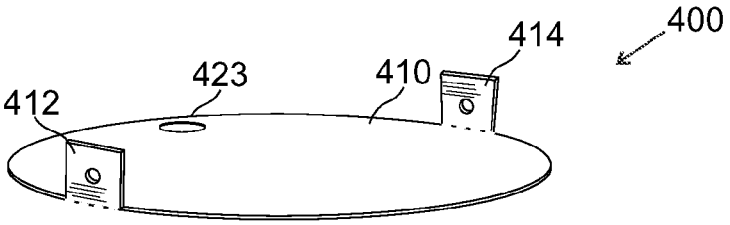
FIG. 4H
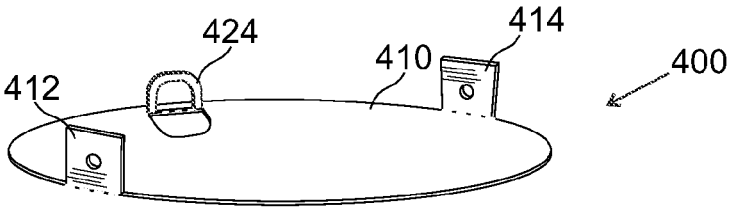
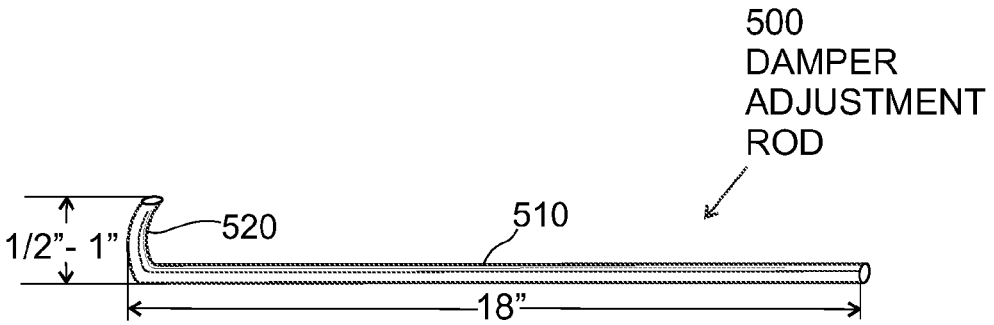
FIG. 5

METHODS AND APPARATUS FOR PROVIDING AN IMPROVED DAMPER, BOOT AND DAMPER COMBINATION, AND AN IMPROVED HVAC DUCT SYSTEM

The present application claims the benefit of U.S. Provisional Application Ser. No. 61/993,096 filed May 14, 2014 which is incorporated by reference herein in its entirety.

FIELD OF THE INVENTION

The present invention relates generally to improved heating, ventilation, and air conditioning (HVAC) systems and components, and, more particularly, to advantageous methods and apparatuses of providing an improved damper in a collar of a boot and its utilization in HVAC systems as addressed further herein.

BACKGROUND OF THE INVENTION

One example of a prior art HVAC duct system 100 is shown in FIG. 1. In this system, a unit 110, such as a heating or an air conditioning unit, supplies heated or cooled air through a duct system 120 which terminates in a plurality of boots 121-126. In the system 100, dampers 131-136 are provided where feeder lines connect the boots 121-126 to a main line 140 of the duct system 100.

One example of a prior art damper 200 suitably used as each of the dampers 131-136 in FIG. 1 is shown in FIG. 2. A threaded extension 202 is rotatably mounted in a mounting hole and a handle 204 can be employed to open, close or otherwise adjust the position of the damper 200. Wing nut 205 allows the position of damper plate 206 to be locked in place once correctly set with the handle 204.

A problem with approaches like those illustrated in FIGS. 1 and 2 is that they require access to a basement or attic where the duct system is located to adjust air flow by adjusting the dampers, and most homeowners and building owners are not particularly comfortable with crawling around a crawl space or an attic. As an example, a misstep in an unfinished attic can result in stepping through a ceiling resulting in the need for a costly repair.

An alternative prior art approach to the damping arrangement of FIG. 1 is shown in FIGS. 3A-3C (collectively FIG. 3). In the approach illustrated by FIG. 3, a boot 300 having a collar 310 terminates in a ceiling register 320. In the collar, a damper like the damper 200 shown in FIG. 2 is mounted in the collar 310, at the mounting holes 311 and 312. This damper has both the same threaded extension 202, handle 204 and wing nut 205 extending outside the collar 310 as seen in FIG. 3B. The handle 204 is accessed by attic access or by removing the ceiling register 320.

SUMMARY OF THE INVENTION

As seen in FIG. 3C, it is desirable for a flexible insulated duct 330 to be pulled down tightly over the boot 300. As seen in FIG. 3B, a typical flexible insulated duct 330 has a flexible liner jacket 340 which fits tightly over collar 310. Wing nut 205 may prevent the flexible liner jacket from being pulled down to completely cover the collar 310 or make a complete pull down unnecessarily difficult and time consuming. If not properly pulled down, leakage may result. Among its several aspects, the present invention recognizes and addresses the above noted problem with the approach of FIGS. 3A-3C. Additionally, simply pulling a looser fitting insulation over the handle 204 covers it up, making it not readily reachable to adjust the position of the damper 200. See FIG. 3C, for example.

To address problems such as those presented by either of the embodiments illustrated in FIGS. 1-3 while still providing a readily reachable and adjustable damper, the present invention provides an improved damper design, an advantageous damper and boot combination, and an improved HVAC duct system, as well as, advantageous methods of using and installing these items.

In accordance with one aspect of the present invention, a damper for mounting inside a circular boot collar of a first diameter is provided. The damper comprises a circular damper plate of a second diameter slightly less than the first diameter; two opposing connectors arranged on opposite sides of the circular diameter plate; and an adjustment mechanism mounted on a bottom face of the circular damper plate and displaced from a center of the circular damper plate.

According to a further aspect of the present invention, a damper and boot combination is provided that comprises a boot having a collar of a first diameter; a circular damper plate of a second diameter slightly less than the first diameter; two opposing connectors arranged on opposite sides of the circular diameter plate; an adjustment mechanism mounted on a bottom face of the circular damper plate and displaced from a center of the circular damper plate; and a mechanical mounting arrangement connecting with said connectors and mounting the damper plate substantially flush with an outer surface of the collar.

According to a further aspect of the invention, a heating, ventilation and air conditioning (HVAC) system is provided that comprises an air unit; a duct system terminating at a plurality of boots, each boot matched with a ceiling register; at least one of said plurality of boots comprising: a collar of a first diameter; a circular damper plate of a second diameter slightly less than the first diameter; two opposing connectors arranged on opposite sides of the circular diameter plate; and an adjustment mechanism mounted on a bottom face of the circular damper plate and displaced from a center of the circular damper plate.

A further aspect of the present invention addresses a method of adjusting air flow through a ceiling register of an HVAC system as addressed above comprising: inserting an adjustment tool through the ceiling register; engaging an adjustment loop on a circular damper; moving the circular damper plate; and disengaging the adjustment loop.

These and other features, aspects, techniques and advantages of the present invention will be apparent to those skilled in the art from the following detailed description, taken together with the accompanying drawings and claims.

BRIEF DESCRIPTION OF THE DRAWINGS

FIG. 1 and FIG. 3;

FIGS. 4A-4H (collectively FIG. 4) illustrate embodiments of dampers in accordance with the present invention;

FIG. 5 illustrates an example of a damper adjustment rod for use in conjunction with the dampers of FIG. 4;

DETAILED DESCRIPTION OF THE DRAWINGS

Figure 1:
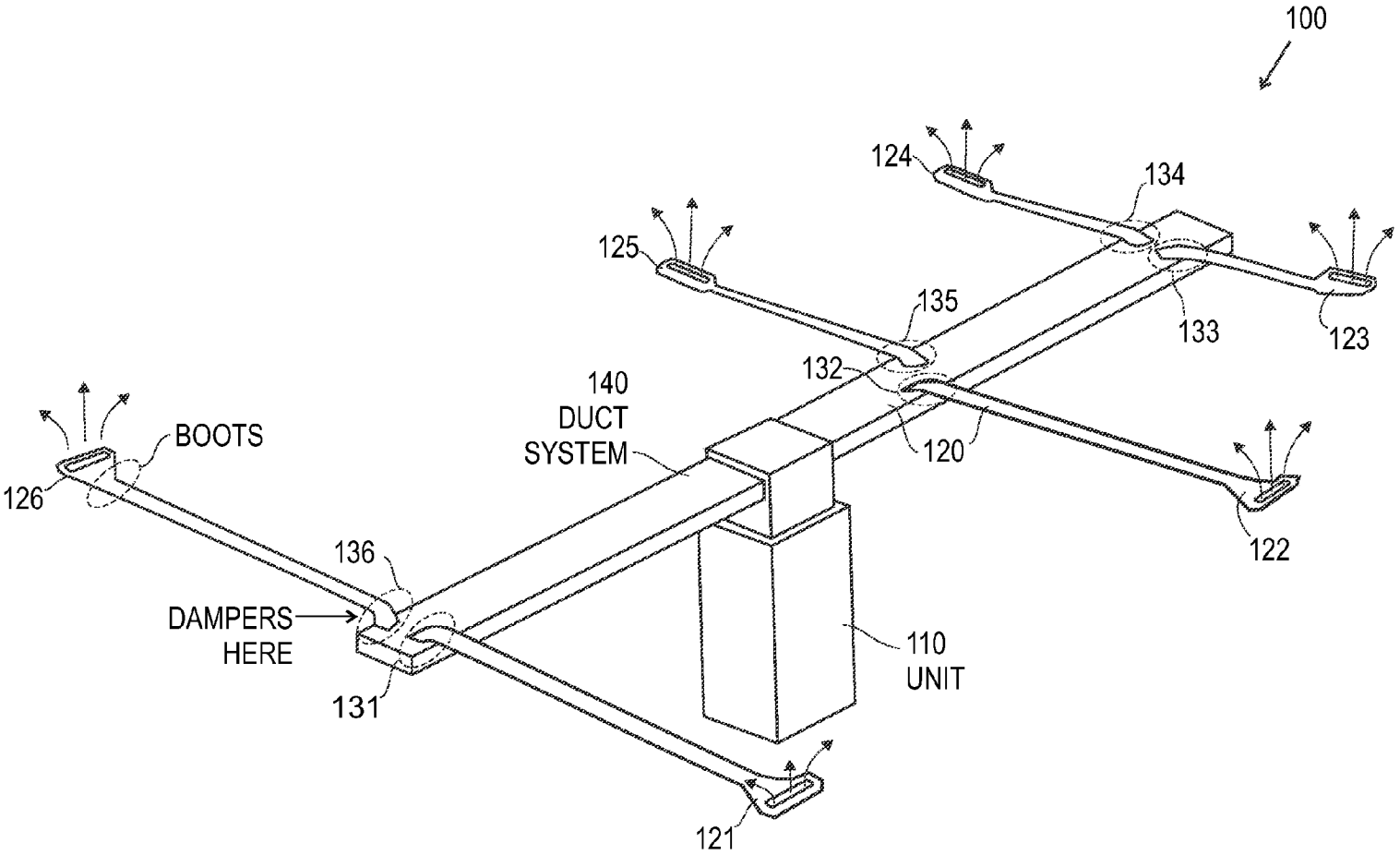
FIG. 1 PRIOR ART
FIG. 1 shows an illustration of a prior art HVAC duct system employing dampers that are inconvenient for a home or other building owner to access.
Figure 2:
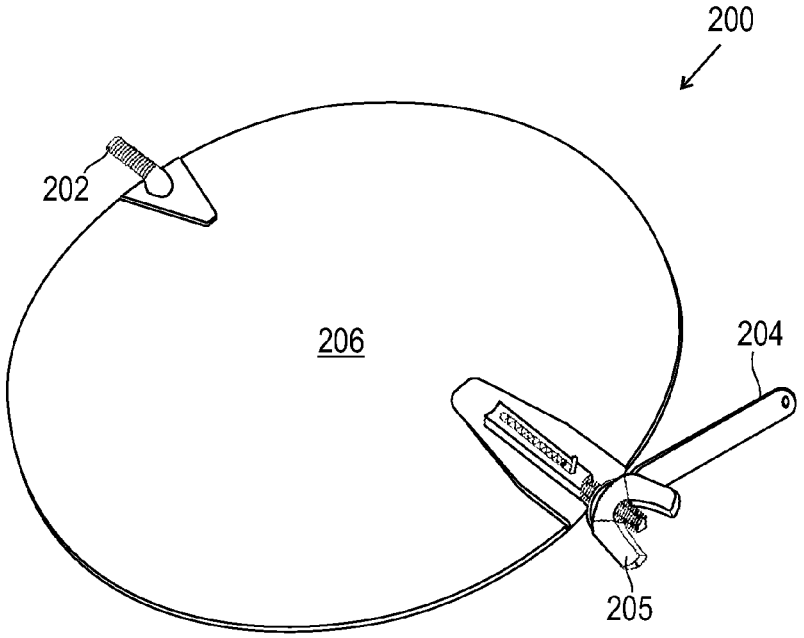
FIG. 2 PRIOR ART
FIG. 2 illustrates an example prior art damper for the prior art embodiment of both.
Figure 4A:
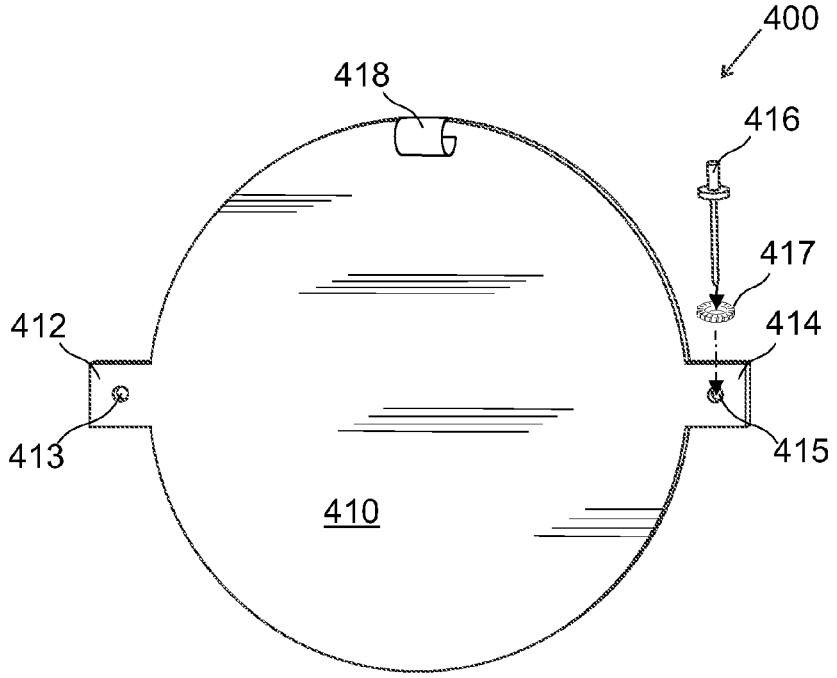
Figure 4B:
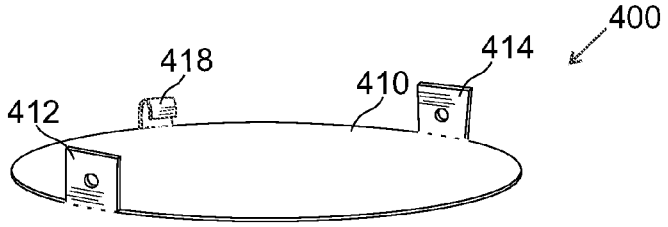
Figure 4C:
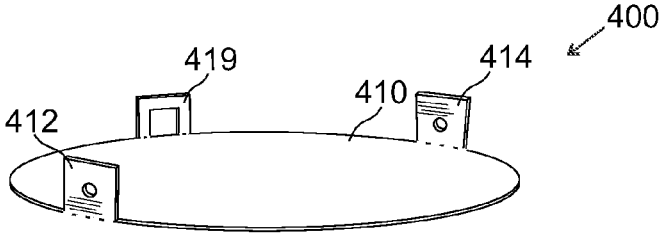
Figure 4D:
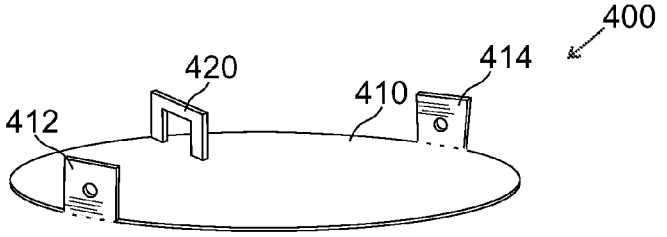
Figure 14:
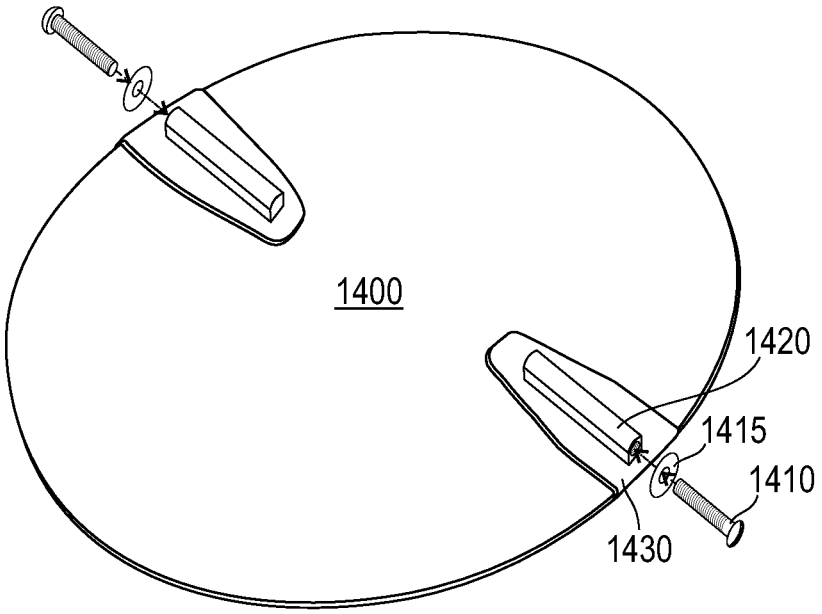
FIG. 14 shows an alternative damper and damper mounting arrangement.

FIGS. 4A and 4B show different views of a damper 400 in accordance with the present invention. As seen in FIG. 4A, damper 400 comprises a round damper plate 410 having connectors 412 and 414, such as ears or tabs, each having a one eighth inch hole 413 and 415, for connection to a collar of a boot, respectively. It will be recognized the one eighth inch hole size is illustrative and that other sizes may be employed as desired to suit the context. Pop rivets, such as pop rivet 416 may suitably be used to attach the connectors 412 and 414 of damper 400 to a collar of a boot, such as boot 710 of FIGS. 7A-7C or the boots seen in any of FIGS. 9-13. In one embodiment, the rivet mounting provides resistance so that once damper plate 410 is adjusted it will not move until physically readjusted by a technician, home owner, or the like. This resistance is sufficient that air flow through a boot does not move damper plate 410. Alternatively, or additionally, a serrated lock washer or other type of lock washer 417 may be employed to provide resistance to rotation as desired. As a further alternative, a clip arrangement similar to the one shown in FIG. 2 may be employed in which a threaded bolt 1410 passes through a serrated washer 1415 and a hole through the neck of a boot, and is then tightened into a threaded member 1420 on a clip 1430 attached to a damper 1400 utilizing a screw driver or other adjustment mechanism calibrated to provide the necessary torque to result in the needed tightness to resist rotation as illustrated in FIG. 14.

While connectors 412 and 414 are shown flat in the plane of circular damper plate 410 in FIG. 4A for ease of illustration. In actual use, they are substantially perpendicular to that plane as seen in FIGS. 4B-4H. Connectors 412 and 414 may be formed by stamping a damper plate 410 including the connectors employing a metal press or a plasma cutter. Alternatively, connectors may be incorporated by spot welding separate metal pieces, fastening separate metal pieces with rivets, or employing any other suitable manufacturing process.

Figure 8:
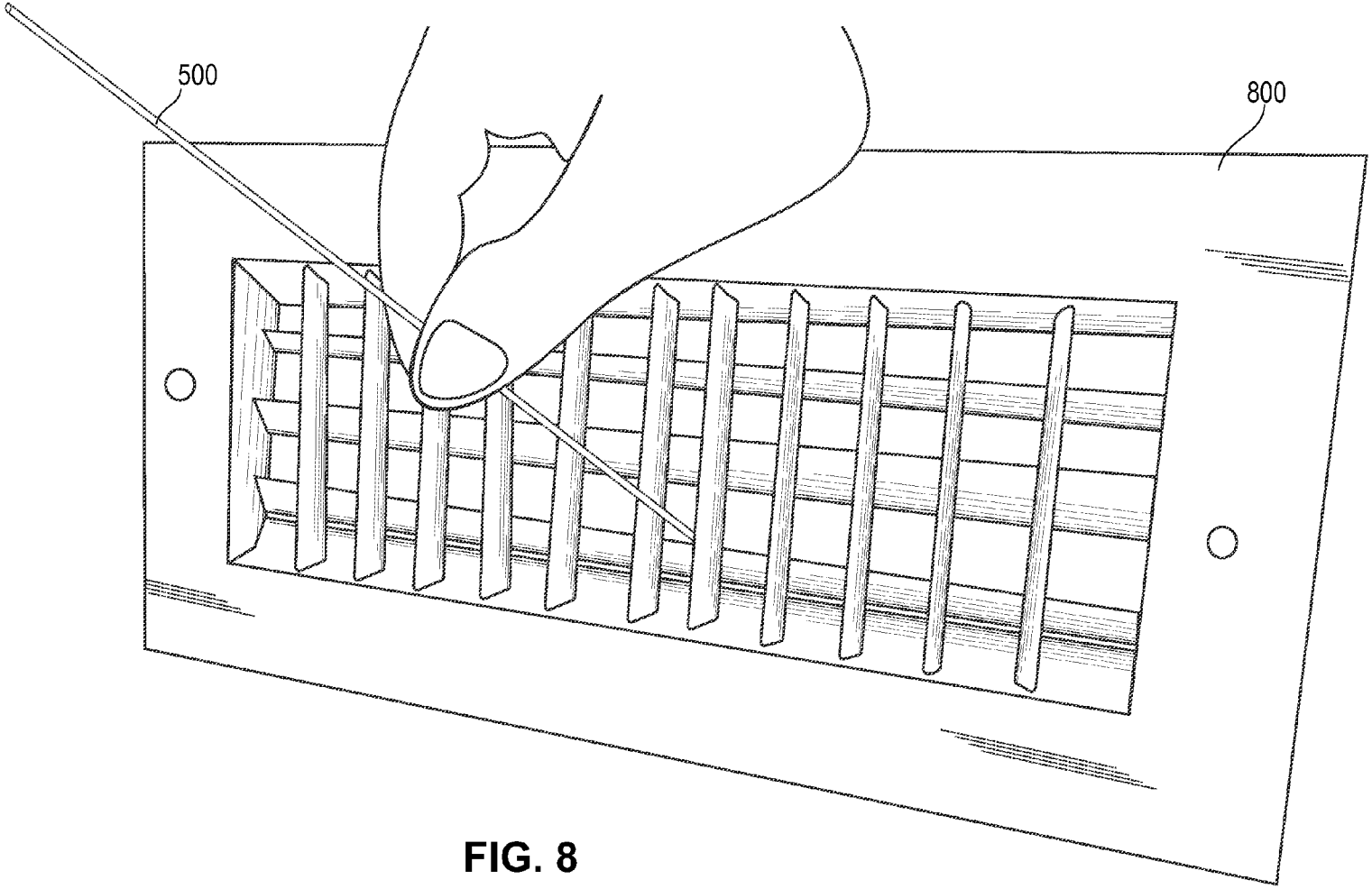
FIG. 8 shows further details of a ceiling register suitable for use in the system of FIG. 7.
Figure 9B:
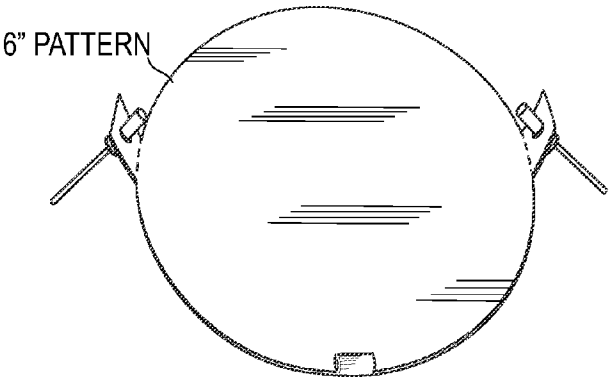
FIGS. 9A, 9B, 10, 11A, 11B, 12A, 12B, 12C and 13 show illustrations of models of various damper parts and components, finished dampers, boot and damper combinations employing dampers in accordance with the present invention; and illustrating how the damper of the present invention can be adjusted.
Figure 9A:
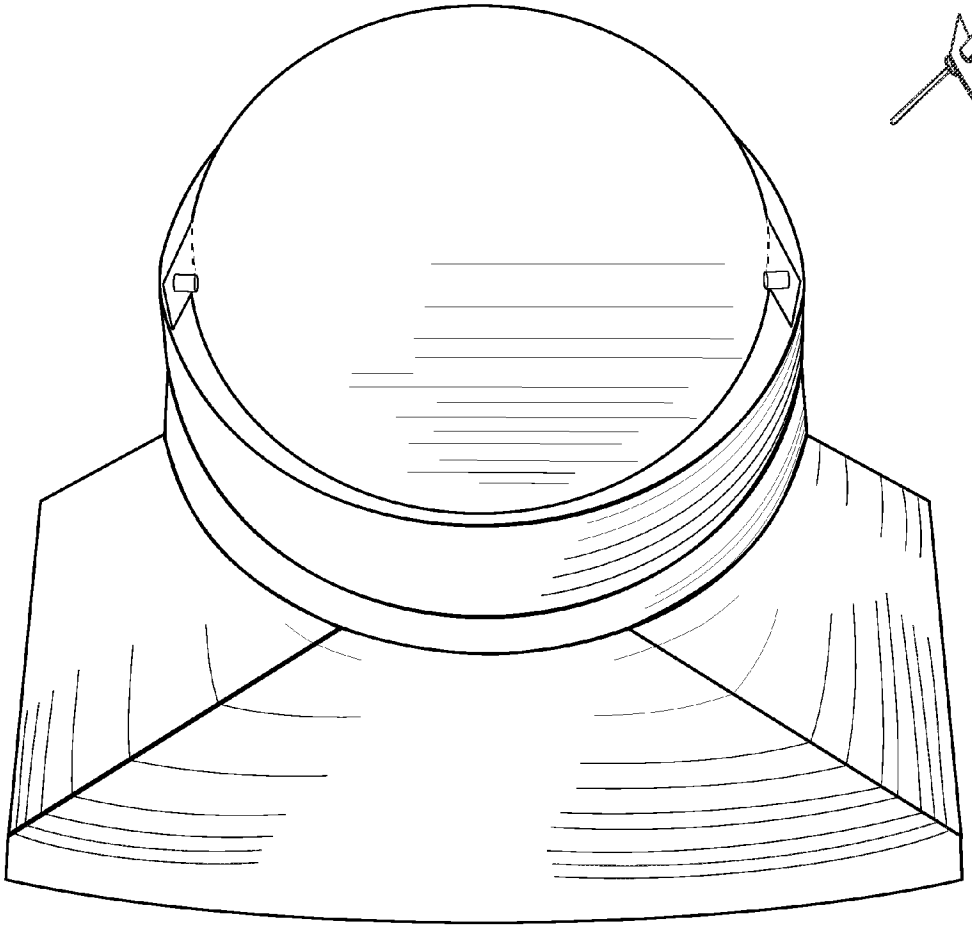
Figure 10:
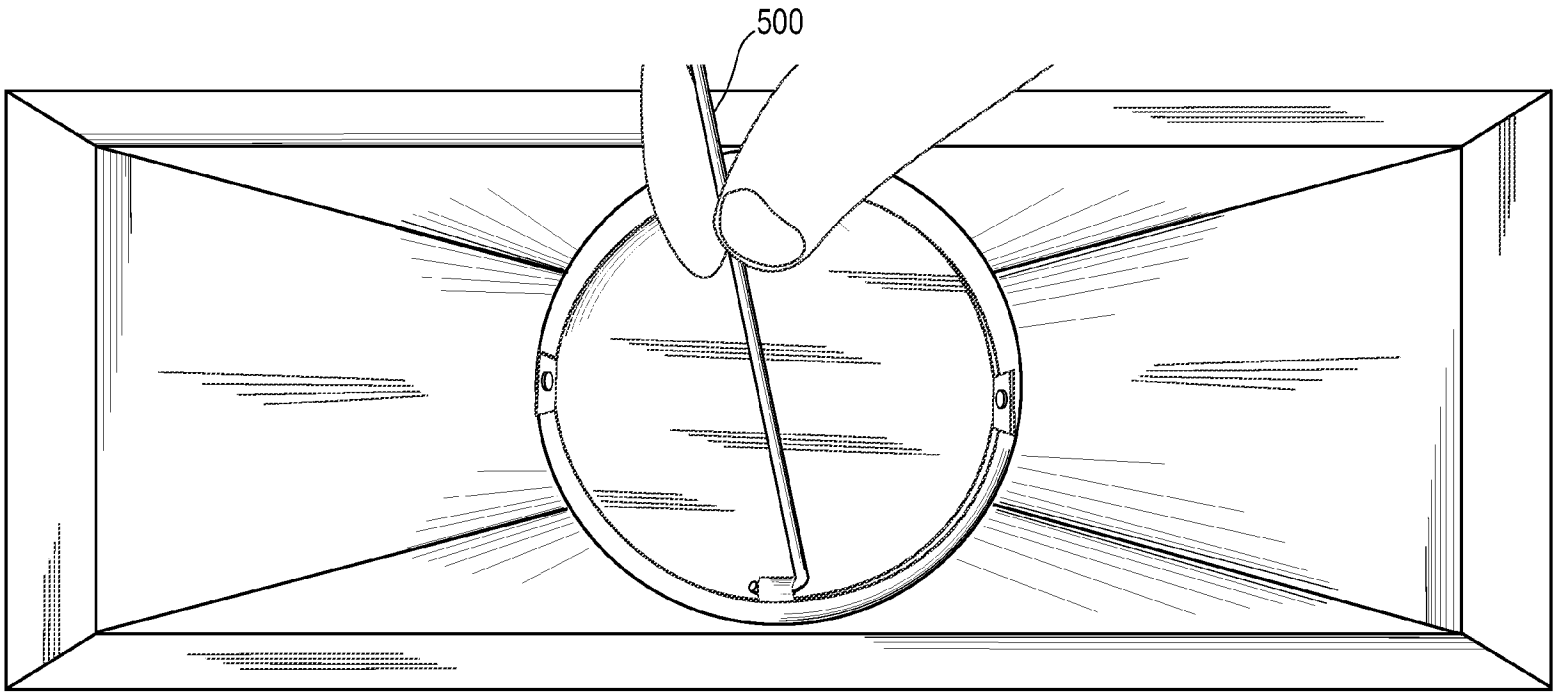
Figure 11B:
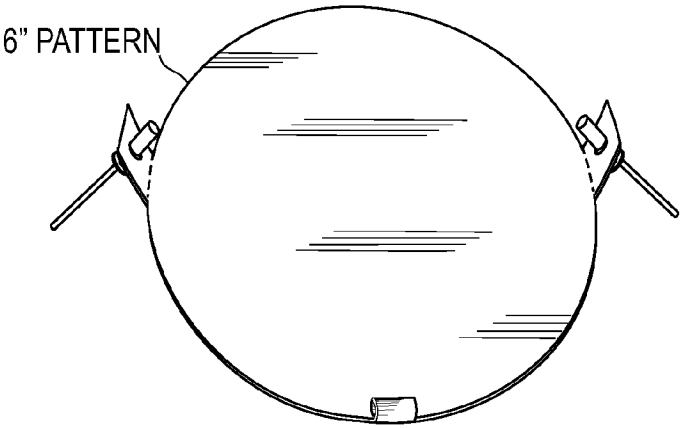
Figure 11A:
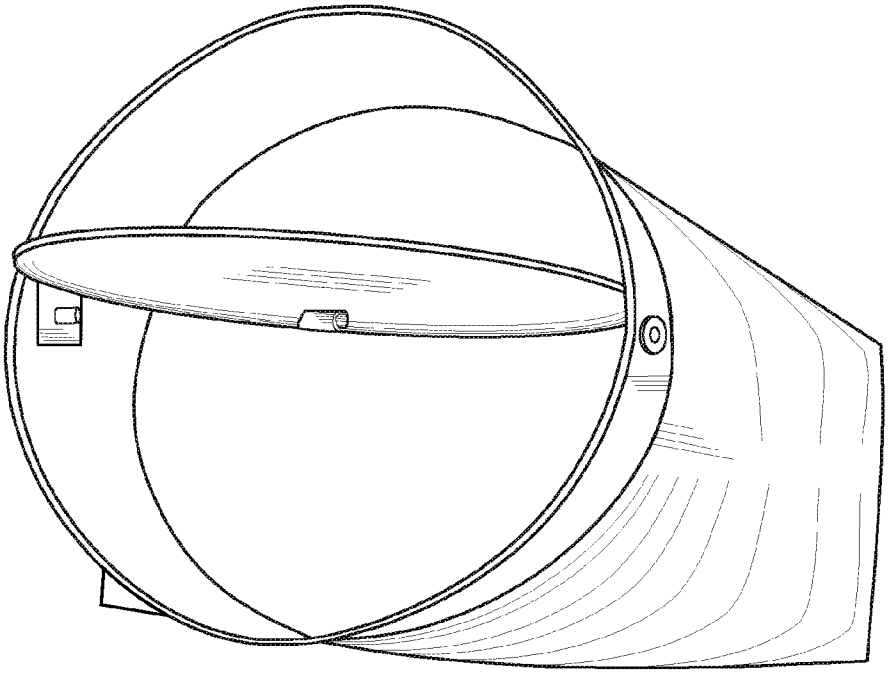
Figure 12C:
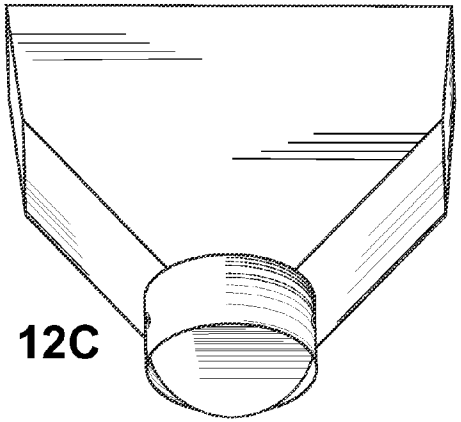
Figure 12B:
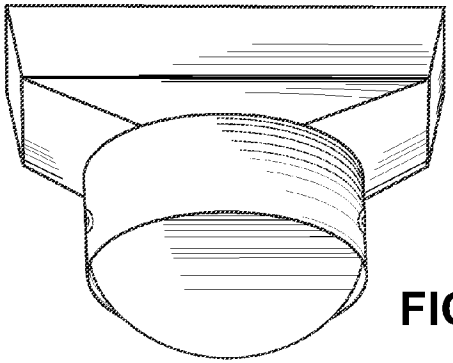
Figure 12A:
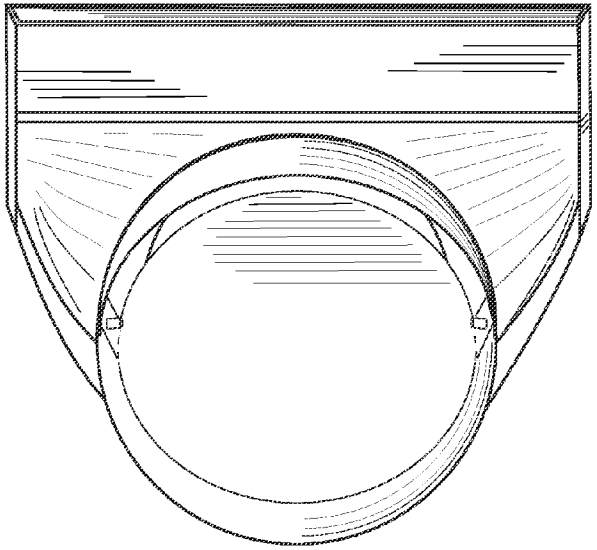
Figure 13:
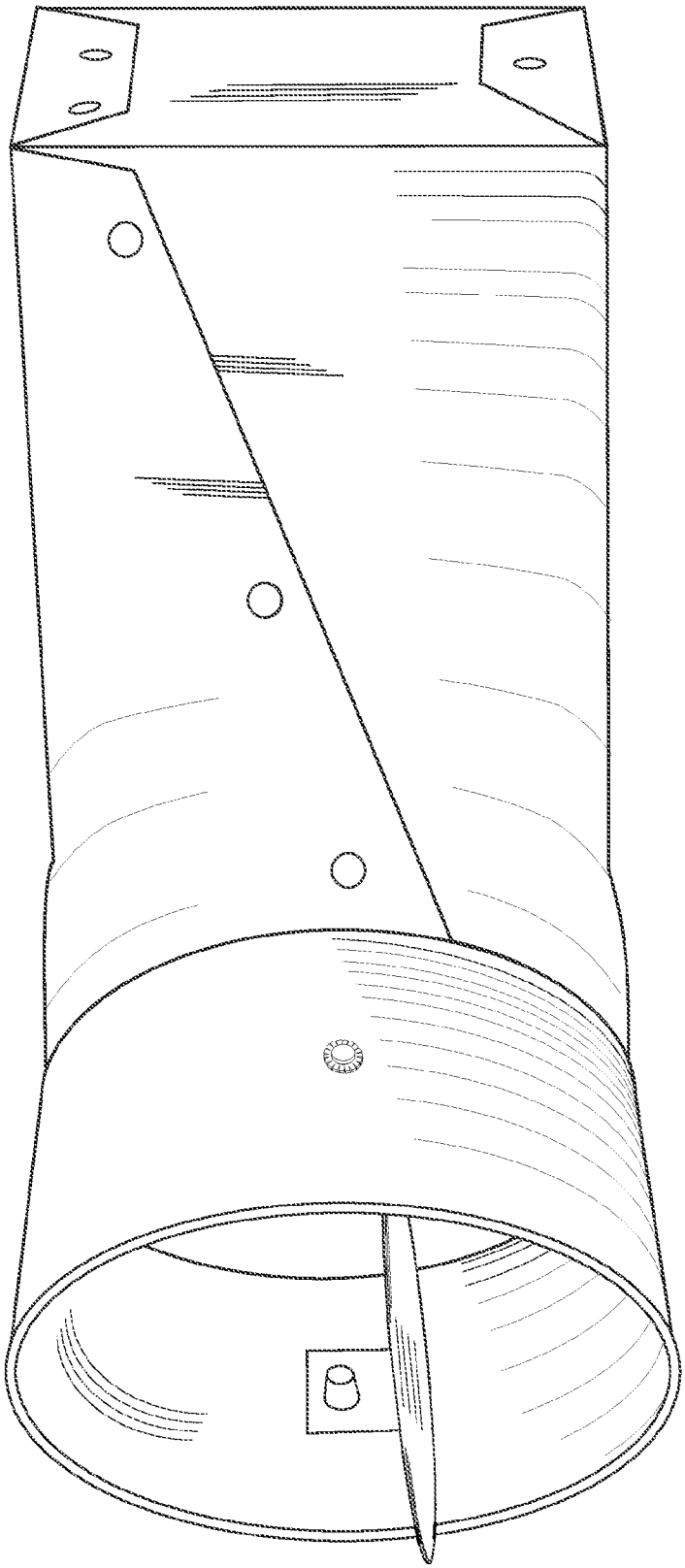

The damper plate 410 as shown in FIG. 4B also includes an adjustment mechanism 418 comprising a metal loop which is advantageously used in conjunction with an adjustment rod 500 shown in FIG. 5 and illustrated in use in FIGS. 9-11. Adjustment mechanism 418 is used for adjustment purposes after installation of all materials and a change in airflow is desired. The adjustment mechanism 418 will allow a technician to use a metal rod 510 equipped with an angle or hook 520 on one end to reach through the standard ceiling register or grill, such as grill 800 of FIG. 8, and adjust the opening, which is controlled by the damper. As seen in FIGS. 4C-4H, alternative adjustment mechanisms 419-424, respectively, may be employed in alternative dampers $\mathbf{400}_C$-$\mathbf{400}_H$, respectively. The purpose is to make adjustments without having to remove the ceiling register at every point of distribution to make adjustments. This approach saves time and money and is highly advantageous in its simplicity.

The damper plate 410 can suitably be 4", 5", 6", 7", 8", 9", 10" or larger as desired to suit a desired context. The dampers and boots shown herein are preferably made of 26 gauge galvanized metal; however, it will be recognized that other materials may be suitably employed, such as aluminum, plastics of suitable strength and able to handle the temperature variations of their context of use, and the like. Further, other gauge metal consistent with any applicable building code or codes may also be used.

Figure 6:
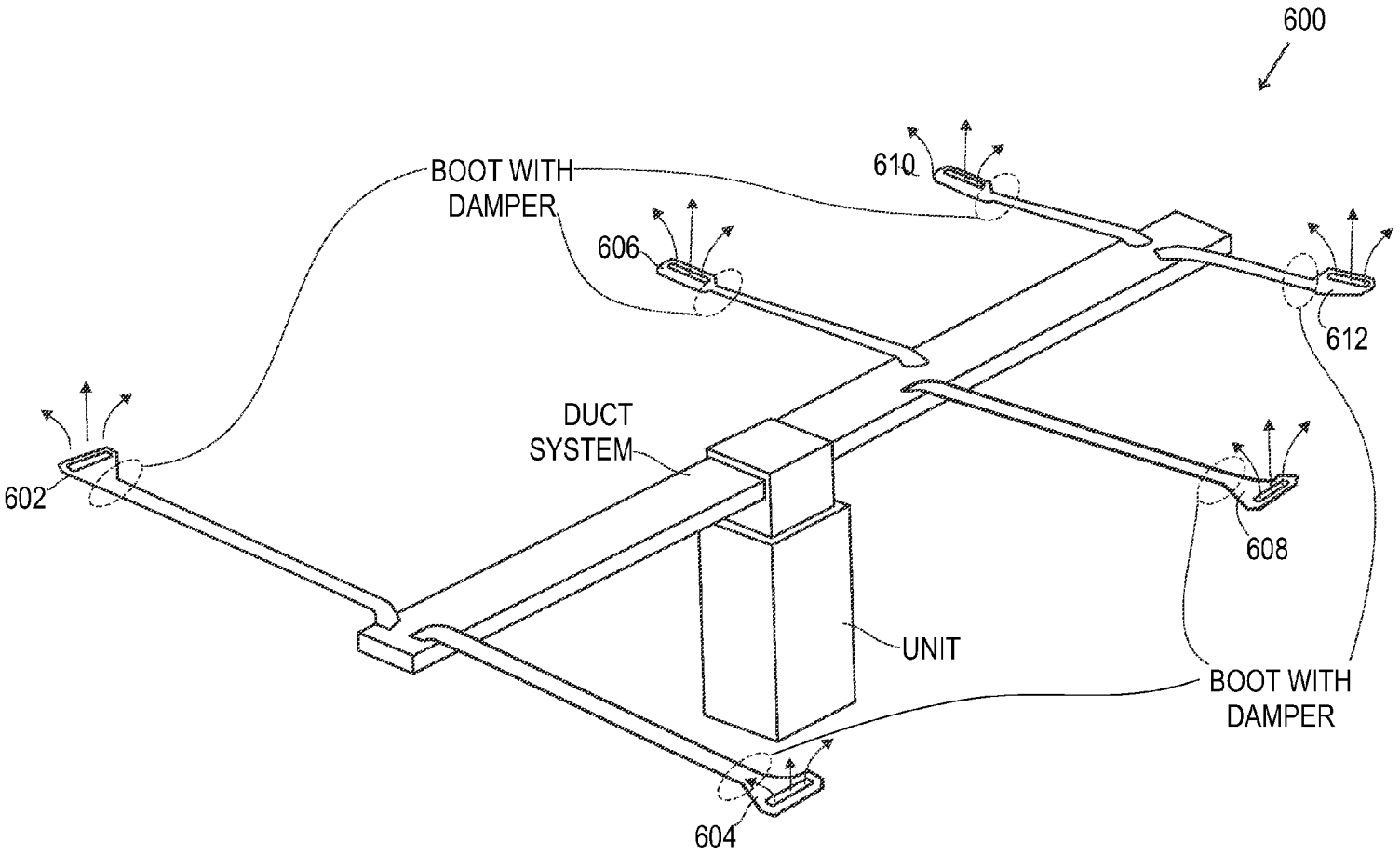
FIG. 6 illustrates an improved HVAC duct system in accordance with the present invention employing dampers like those shown in FIG. 4 located in the necks of the boots.

FIG. 6 shows an HVAC duct system 600 in accordance with an embodiment of the present invention. In the system 600, dampers like the damper 400 of FIGS. 4A and 4B are included in collars of boots 602, 604, 606, 608, 610 and 612, respectively. As a result, the damper is in close proximity with a ceiling grill or register, and now is accessible to a home or building owner, occupant, or the like. Airflow adjustments can now be made in a more timely manner and near the point of termination. See, for example, FIGS. 8 and 10. Adjustments can be made without removing the ceiling grill from the ceiling. Further, with the rivet fastening mechanism shown in FIG. 4A, as well as, FIGS. 7B and 9-13, for example, there is little or no air leakage.

Figure 3A:
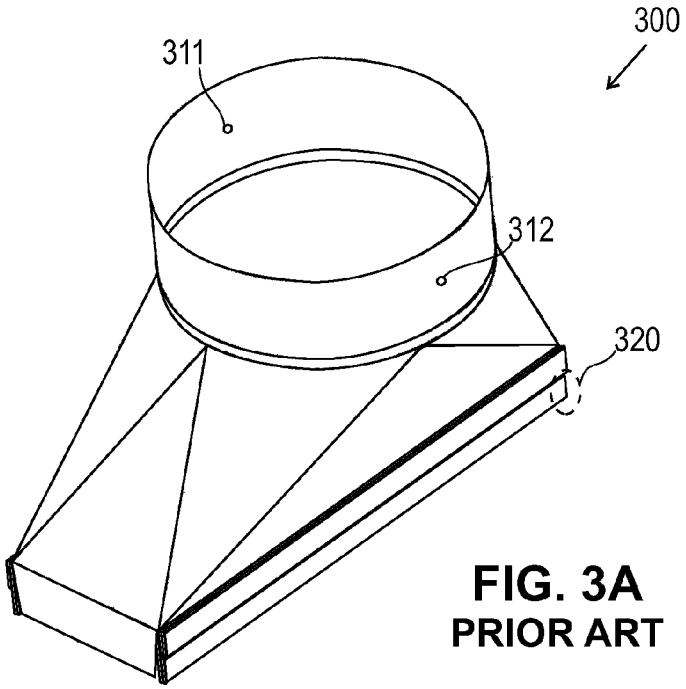
FIG. 3A PRIOR ART
FIGS. 3A-3C (collectively FIG. 3) illustrate an alternative boot arrangement in which a damper like that of FIG. 1 is incorporated in a boot.
Figure 3B:
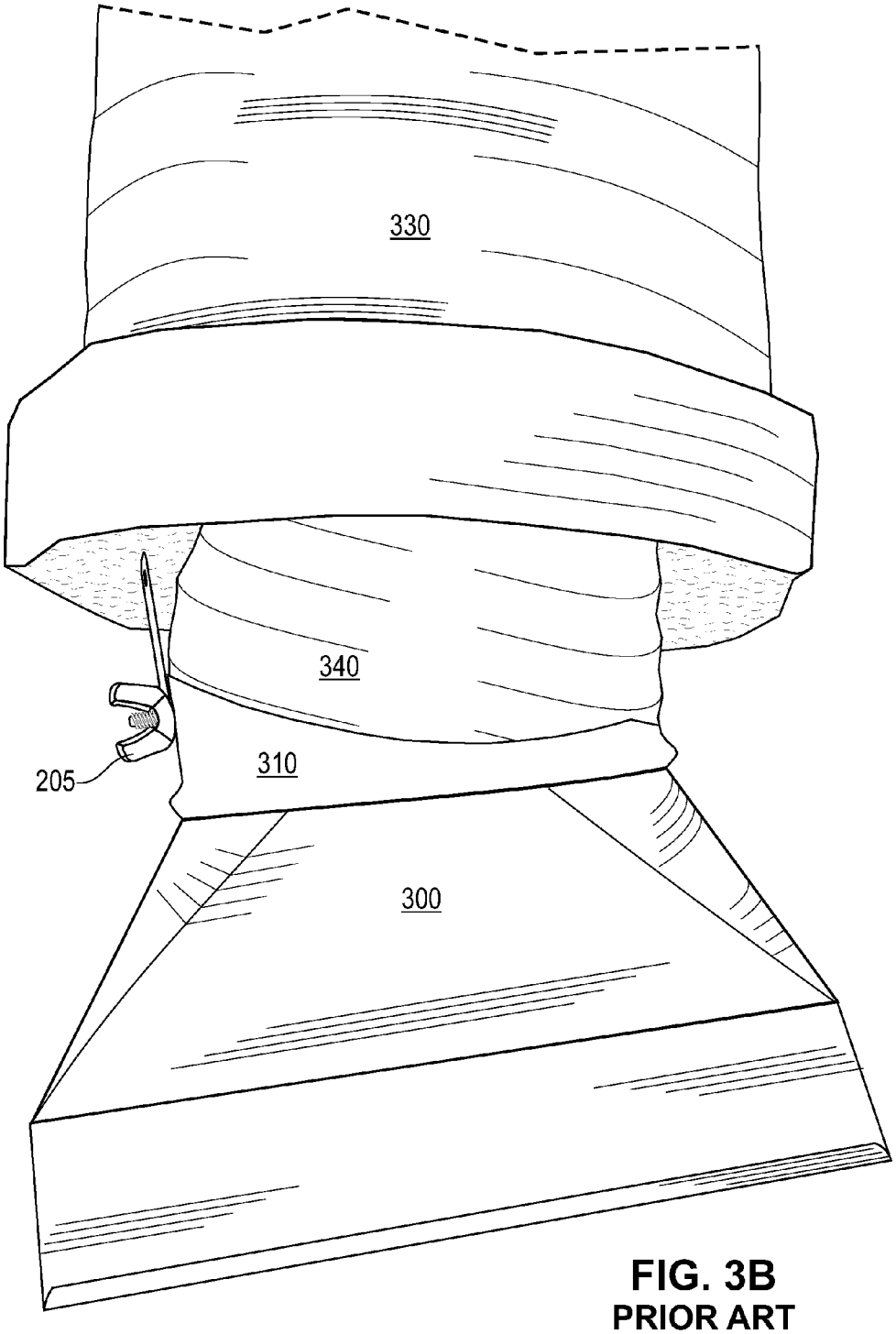
FIG. 3B PRIOR ART
Figure 3C:
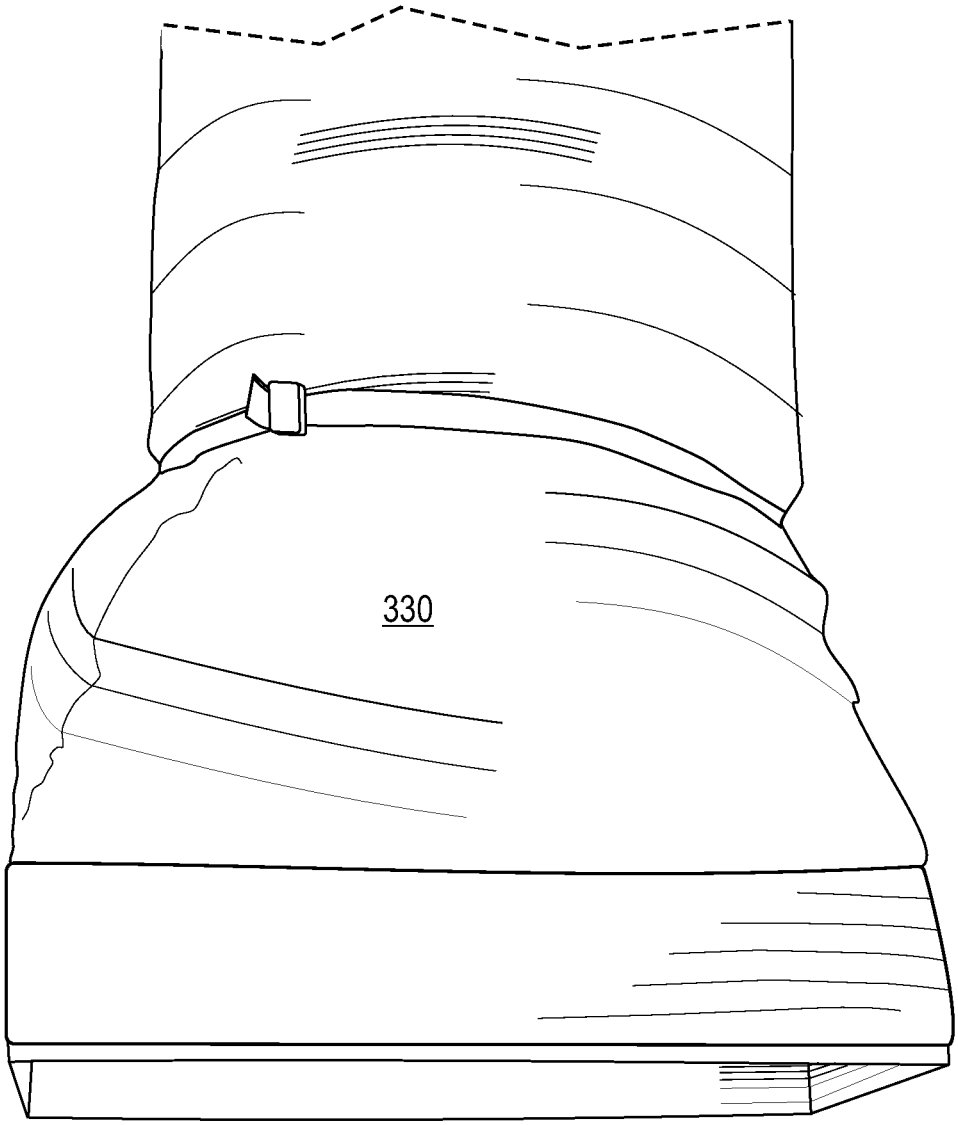
FIG. 3C PRIOR ART

In the approach shown in FIG. 3, the ceiling grill and the boot are generally pulled down through the ceiling to gain access to handle 204 to adjust the damper 200. This approach can increase the time needed to make the adjustment, can be found daunting by a typical homeowner, or the like, and may result in damage to the ceiling upon removal and replacement of the grill. By contrast, the present invention allows a simple hook and rod, such as rod 500, shown in FIG. 5, to be employed as shown in FIGS. 8 and 10, for example. This approach eliminates the need to remove the ceiling grill and is substantially more likely to be an adjustment the typical building owner or occupant is comfortable with making him or herself.

Figure 7A:
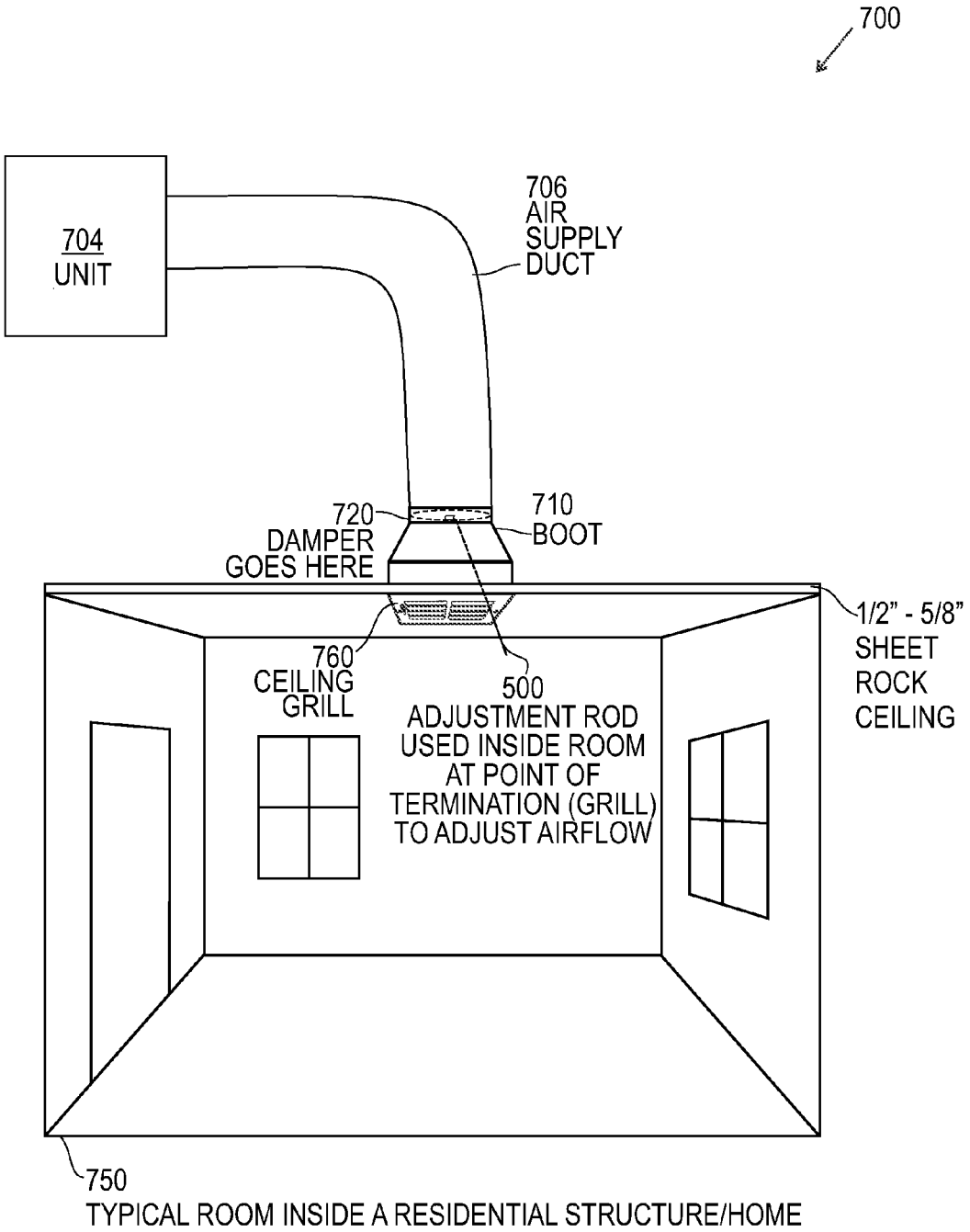
FIGS. 7A-7C (collectively FIG. 7) illustrate further details of a boot and damper combination employed in an HVAC system in accordance with the present invention.
Figure 7B:
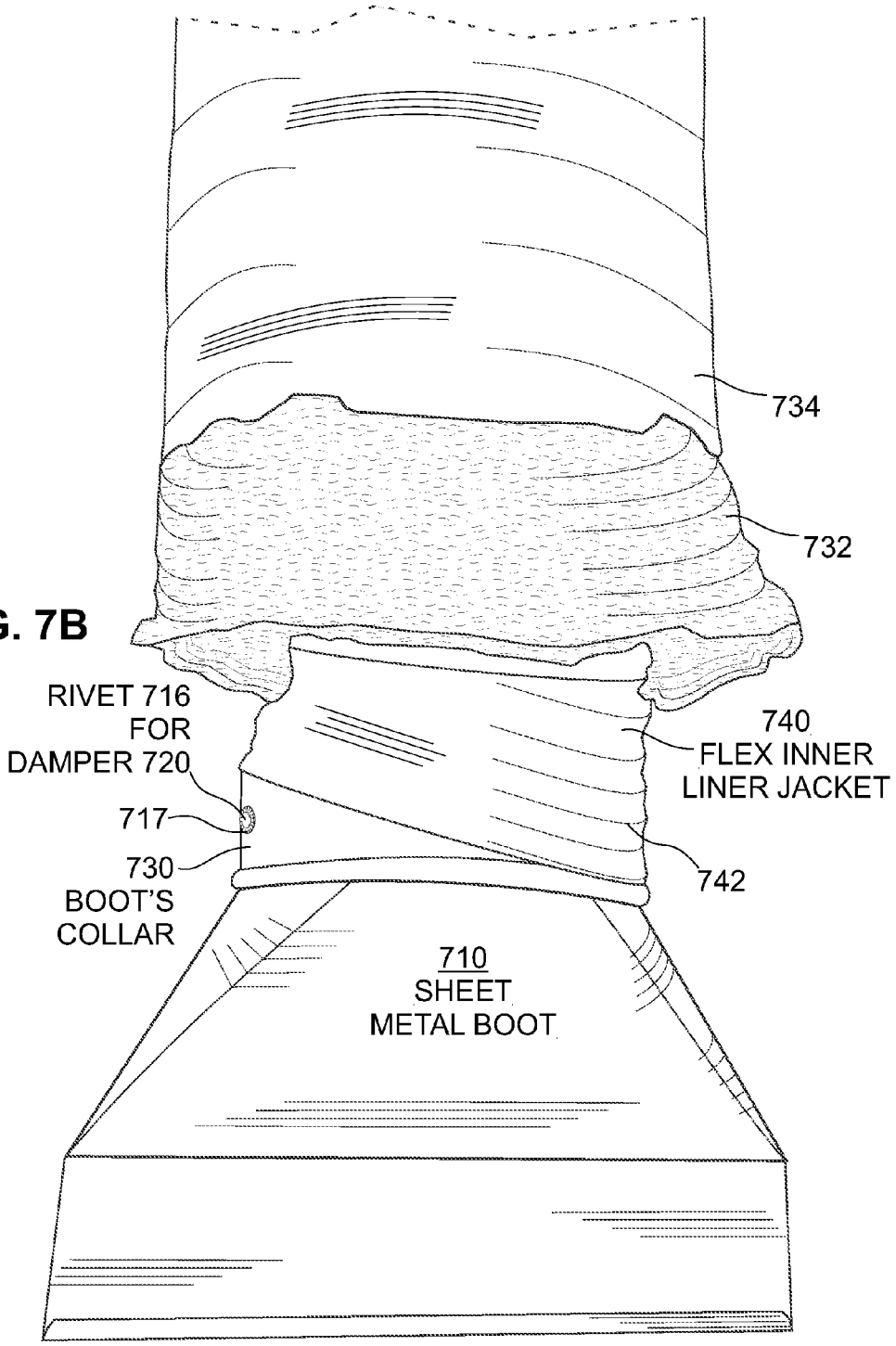
Figure 7C:
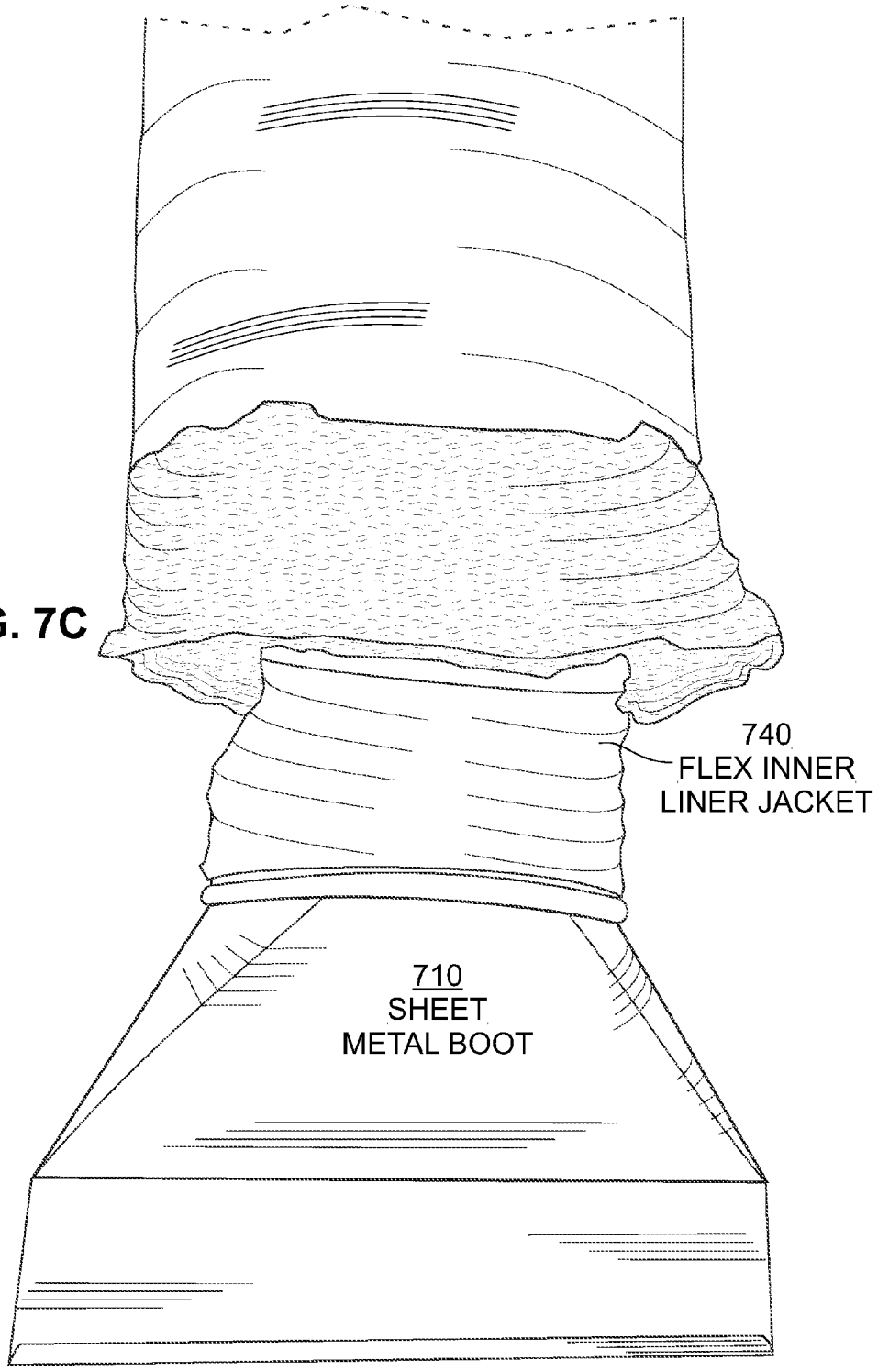

FIGS. 7A-7C (collectively FIG. 7) illustrate further aspects of a system 700, according to an aspect of the present invention, installed to provide HVAC in a typical room 750 inside a residential structure, such as a home. As seen in FIG. 7A, system 700 includes a heating and air unit 704 which provides a supply of heated or cooled air through an air supply duct 706. As seen in FIG. 7B, air supply duct 706 may suitably comprise an insulator 732 between an outer sheath or jacket 734. An inner liner jacket 740 will typically have strengthening wire 742 to provide strength, but which limits how big a collar the jacket can fit over. Air supply duct 706 terminates at a boot 710 having a damper 720 in its neck or collar 730 as best seen in FIG. 7B.

Unlike the handle 204 or wing nut 205 of FIG. 3B, a first rivet 716 and serrated lock washer 717 of FIG. 7B and second rivet and serrated lock washer 180° opposed thereto (not shown) are substantially flush with the outer surface of collar 730 allowing the flexible inner liner jacket 740 to be readily pulled down over those rivets as seen in FIG. 7C facilitating the attachment of the air supply duct 706 to the metal boot 710. In operation, unit 704 supplies heated or cooled air through air supply duct 706 to boot 710 and through ceiling grill 745 to the room 750.

FIG. 8 shows further details of a typical ceiling register 800 that may be suitably be employed as ceiling grill 760 in FIG. 7A. Ceiling register 800 is typically attached to the bottom of boot 710. In accordance with the present invention, an adjustment rod, such as rod 500, is reached through the ceiling grill and the damper 720 is adjusted without removing the ceiling grill 760. As seen in FIGS. 7B and 7C, insulation can be readily pulled over boot 710 as rivet 720 is substantially flush with the outer surface of the boot's collar 730.

FIGS. 9-13 illustrate further details of actual models and prototypes of dampers, damper and boot combinations and the like in accordance with aspects of the present invention.

Those of skill in the art will appreciate from the present disclosure additional, alternative systems and methods for adapting the described approaches to other contexts and environments, in accordance with the disclosed principles of the present invention. Thus, while particular embodiments and applications of the present invention have been illustrated and described, it is to be understood that the invention is not limited to the precise construction and components disclosed herein and that various modifications, changes and variations which will be apparent to those of ordinary skill in the art may be made in the arrangement, operation and details of the method and apparatus of the present invention disclosed herein without departing from the spirit and scope of the invention. As one example, while particular diameter dampers and boots are shown here, it will be recognized that other sizes and shapes may be employed as desired. The same is true as to other components for which presently preferred dimensions are disclosed, but for which it will be recognized that variations may be made as desired to fit the needs of a particular installation.

I claim:

1. A damper to be mounted inside a circular boot collar of a first diameter comprising:

a circular damper plate of a second diameter slightly less than the first diameter;

two diametrically opposed connectors arranged at opposite ends of a diameter of the circular damper plate;

a hole in each of the two diametrically opposed connectors;

a rivet for mounting each of the two diametrically opposed connectors of said damper to the circular boot collar with an outermost surface of the rivet substantially flush with an outer surface of the circular boot collar, wherein the rivets clamp against the circular boot collar providing sufficient clamping force whereby the circular damper plate is not moved by normal air flow through the circular boot collar during use in a heating, ventilation and air conditioning system; and an adjustment mechanism mounted on a bottom face of the circular damper plate and displaced from a center of the circular damper plate.

2. The damper of claim 1 wherein the adjustment mechanism is spot welded to the bottom face of the circular damper plate.

3. A damper and boot combination comprising:

a boot having a circular collar of a first diameter;

a circular damper plate of a second diameter slightly less than the first diameter;

two diametrically opposed connectors arranged at opposite ends of a diameter of the circular damper plate;

an adjustment mechanism mounted on a bottom face of the circular damper plate and displaced from a center of the circular damper plate; and a mechanical mounting arrangement for mounting the circular damper plate to the collar wherein the two diametrically opposed connectors each have a hole, and the mechanical mounting arrangement comprises a rivet for each diametrically opposed connector with an outermost surface of each rivet substantially flush with an outer surface of the circular collar.

4. The damper and boot combination of claim 3 further comprising:

a circular sleeve of insulation pulled snugly down over said collar.

5. The damper and boot combination of claim 3 wherein the rivets clamp against the circular collar providing sufficient clamping force whereby the circular damper plate is not moved by normal air flow through the circular collar during use in a heating, ventilation and air conditioning system.

6. A heating, ventilation and air conditioning (HVAC) system comprising:

an air unit;

a duct system terminating at a plurality of boots, each boot matched with a ceiling register;

at least one of said plurality of boots comprising:

a circular collar of a first diameter;

a circular damper plate of a second diameter slightly less than the first diameter;

two diametrically opposed connectors arranged at opposite ends of a diameter of the circular damper plate, a hole in each of the two diametrically opposed connectors;

a rivet for mounting each of the two diametrically opposed connectors of said damper to the circular boot collar with an outermost surface of the rivet substantially flush with an outer surface of the circular boot collar, wherein the rivets clamp against the circular boot collar providing sufficient clamping force whereby the circular damper plate is not moved by normal air flow through the circular boot collar during use in a heating, ventilation and air conditioning system; and an adjustment mechanism mounted on a bottom face of the circular damper plate and displaced from a center of the circular damper plate.

7. A method of adjusting air flow through a ceiling register of a heating, ventilation and air conditioning system comprising a circular damper plate with two diametrically opposed connectors each having a hole, and a mechanical mounting arrangement to attach the circular damping plate to a circular collar of a boot, the mechanical mounting arrangement comprising a rivet for mounting each of the diametrically opposed connectors of said damper to the circular boot collar with an outermost surface of the rivet substantially flush with an outer surface of the circular boot collar, wherein the rivets clamp against the circular boot collar providing sufficient clamping force whereby the circular damper plate is not moved by normal air flow through the circular boot collar during use in the heating, ventilation and air conditioning system, an adjustment mechanism mounted on the circular damper plate, and a ceiling register, the method comprising:

inserting an adjustment tool through the ceiling register;

engaging the adjustment mechanism;

moving the circular damper plate inside the circular collar; and disengaging the adjustment mechanism.

* * * * *